US006189314B1

(12) United States Patent
Yamamoto et al.

(10) Patent No.: US 6,189,314 B1
(45) Date of Patent: Feb. 20, 2001

(54) PREMIX COMBUSTOR FOR GAS TURBINE ENGINE

(75) Inventors: Yoshiharu Yamamoto; Eiichi Utsugi; Nobuyuki Kobayashi; Hidehiko Nakata, all of Wako (JP)

(73) Assignee: Honda Giken Kogyo Kabushiki Kaisha, Tokyo (JP)

( * ) Notice: Under 35 U.S.C. 154(b), the term of this patent shall be extended for 0 days.

(21) Appl. No.: 09/385,058

(22) Filed: Aug. 30, 1999

(30) Foreign Application Priority Data

Sep. 1, 1998 (JP) ..... 10-247021
Sep. 1, 1998 (JP) ..... 10-247022

(51) Int. Cl.[7] ..... F02C 3/14; F02C 7/22; F23R 3/30

(52) U.S. Cl. ..... 60/39.36; 60/737; 60/743; 60/746

(58) Field of Search ..... 60/39.36, 737, 60/738, 740, 743, 746, 747

(56) References Cited

U.S. PATENT DOCUMENTS 2,553,867 * 5/1951 Panducci ..... 60/39.36
3,691,762 * 9/1972 Ryberg et al. ..... 60/743
3,912,164 * 10/1975 Lefebvre et al. ..... 60/743
4,170,108 * 10/1979 Mobsby ..... 60/740
4,589,260 5/1986 Krockow .

FOREIGN PATENT DOCUMENTS 7-332671 12/1995 (JP) .

* cited by examiner

*Primary Examiner*—Louis J. Casaregola
(74) *Attorney, Agent, or Firm*—Arent Fox Kintner Plotkin & Kahn, PLLC

(57) ABSTRACT

A premixing section for supplying a fuel-air mixture to a homogeneous combustion chamber includes a first fuel nozzle disposed along an axis, a second fuel nozzle disposed to surround the outer periphery of the first fuel nozzle, and a premixing/pre-evaporating chamber. The first fuel nozzle is a diffusion combustion type nozzle and supplies the fuel-air mixture from an air blast-type nozzle tip directly to the homogeneous combustion chamber. The second fuel nozzle is a premixing/pre-evaporating type nozzle and supplies the fuel-air mixture from an air blast-type nozzle tip to the premixing/pre-evaporating chamber, so that the fuel-air mixture promoted in mixing and evaporation in the premixing/pre-evaporating chamber, is supplied via a swirler to the homogeneous combustion chamber. With the above arrangement, the atomization of the fuel enhances the emission characteristics.

6 Claims, 7 Drawing Sheets

PREMIX COMBUSTOR FOR GAS TURBINE ENGINE

BACKGROUND OF THE INVENTION

1. Field of the Invention

The present invention relates to a combustor for a gas turbine engine, utilizing a combination of a diffusion combustion system and a premixing/pre-evaporating combustion system, or a combustor for a gas turbine engine, including a premixing/pre-evaporating chamber.

2. Description of the Related Art

Combustors for a gas turbine engine are already known from U.S. Pat. No. 4,589,260 and Japanese Patent Application Laid-open No. 7-332671. A first fuel nozzle for diffusion combustion disposed on the axis of the gas turbine engine combustor of the latter publication, is designed to inject fuel under pressure directly into a combustion chamber. A second fuel nozzle for premixing/pre-evaporating combustion disposed to surround an outer periphery of the first fuel nozzle, includes a louver disposed within an annular premixing/pre-evaporating chamber in which a swirled air flow generated by a swirler flows; and is designed to atomize the fuel injected from a fuel injecting port into the premixing/pre-evaporating chamber by collision of the fuel against the louver.

The combustor for the gas turbine engine of the above-described Japanese publication suffers from a problem that it is difficult to sufficiently atomize fuel, resulting in a degraded emission characteristic, because the first fuel nozzle injects the fuel under pressure directly into the combustion chamber. The combustor also suffers from another problem that it is difficult to appropriately design the shape of the louver and the relative positional relationship between the louver and the fuel injection port, because the fuel injected from the fuel injection port by the second fuel nozzle must be atomized by collision against the louver, and also the number of parts is increased due to the provision of the louver.

The combustor for the gas turbine engine of the above-described Japanese publication includes an annular premixing/pre-evaporating chamber surrounding the axis, and a homogeneous combustion chamber connected to a downstream portion of the premixing/pre-evaporating chamber, so that the air and fuel fed to the premixing/pre-evaporating chamber are supplied to the homogeneous combustion chamber in a state in which the air and fuel are atomized by generating swirled flows thereof.

In the combustor for the gas turbine engine where the premixing/pre-evaporating chamber is at a location upstream of the homogeneous combustion chamber, the following problem is encountered: A fuel-air mixture in the premixing/pre-evaporating chamber may be self-ignited by a back fire from the homogeneous combustion chamber in some cases. Particularly, in the center portion of the premixing/pre-evaporating chamber, the swirled flows stagnate, resulting in a reduced flow speed and for this reason, the self-ignition phenomenon is liable to be produced.

SUMMARY OF THE INVENTION

Accordingly, it is a first object of the present invention to ensure that the atomization of the fuel is promoted to enhance the emission characteristic in the combustion for the gas turbine engine utilizing the combination of the diffusion combustion system and the premixing/pre-evaporating combustion system.

It is a second object of the present invention to ensure that the self-ignition phenomenon due to the stagnation of the swirled flows in the premixing/pre-evaporating chamber is prevented in the combustor for the gas turbine engine including the premixing/pre-evaporating chamber.

To achieve the above first object, according to a first aspect and feature of the present invention, there is provided a combustor for a gas turbine engine, comprising a single can type homogeneous combustion chamber disposed on an axis of an engine casing, a first fuel nozzle disposed on the axis for supplying a fuel-air mixture to an upstream end of the homogeneous combustion chamber, and a premixing/pre-evaporating chamber surrounding an outer periphery of the first fuel nozzle and connected to the upstream end of the homogeneous combustion chamber, and a second fuel nozzle surrounding the outer periphery of the first fuel nozzle for supplying the fuel-air mixture to the upstream end of the premixing/pre-evaporating chamber. The first fuel nozzle is an air blast nozzle which includes a first fuel liquid film forming passage disposed on the axis for supplying the fuel, and a first annular air passage surrounding an outer periphery of the first fuel liquid film forming passage for supplying air. The second fuel nozzle is an air blast nozzle which includes a second annular fuel liquid film forming passage surrounding the outer periphery of the axis for supplying the fuel, and a second annular air passage surrounding an outer periphery of the second fuel liquid film forming passage for supplying air.

With the above arrangement, the homogeneous combustion chamber, the premixing/pre-evaporating chamber, the first fuel nozzle and the second fuel nozzle are disposed axially symmetrically with respect to the axis of the engine casing. Therefore, the flow of the air, the fuel, the fuel-air mixture and a combustion gas are axially symmetrical and circumferentially uniform. Thus, the pressure loss can be decreased to provide an increase in power output and a reduction in fuel consumption. Also the fuel-air ratio of the fuel-air mixture supplied to the homogeneous combustion chamber is circumferentially uniform to enhance the emission characteristic and moreover, the profile of temperature in the combustor is axially symmetrical, whereby the thermal strain of various parts is suppressed to a minimum.

In addition, since the first fuel nozzle for diffusion combustion having excellent igniting performance and flame stabilizing performance and the second fuel nozzle for premixing/pre-evaporating combustion having an excellent emission characteristic, are used in combination, the igniting performance and flame stabilizing performance and the emission characteristic can all be reconciled.

Further, the first fuel nozzle for diffusion combustion for supplying the fuel-air mixture directly to the homogeneous combustion chamber comprises an air blast nozzle which includes a first fuel liquid film forming passage disposed on the axis for supplying the fuel, and a first annular air passage disposed to surround the outer periphery of the first fuel liquid film forming passage for supplying air. Therefore, the fuel can be atomized sufficiently by the first fuel nozzle to contribute to an enhancement in the emission characteristic. Additionally, the second fuel nozzle for premixing/pre-evaporating combustion for supplying the fuel-air mixture to the homogeneous combustion chamber through the premixing/pre-evaporating chamber comprises an air blast nozzle which includes a second annular fuel liquid film forming passage disposed to surround the outer periphery of the axis for supplying the fuel and a second annular air passage being disposed to surround the outer periphery of the second fuel liquid film forming passage for supplying air.

Therefore, the cooperation of the atomization of the fuel by the first fuel nozzle and the premixing/pre-evaporating effect for the fuel-air mixture provided by the premixing/pre-evaporating chamber can contribute to a further enhancement of the emission characteristic.

To achieve the above first object, according to a second aspect and feature of the present invention, a ignition plug is disposed in the vicinity of the nozzle tip of the first fuel nozzle.

With the above arrangement, the ignition plug is disposed in the vicinity of the nozzle tip of the first fuel nozzle for supplying the fuel at the start of the gas turbine engine. Therefore, the fuel-air mixture supplied from the nozzle tip of the first fuel nozzle at the start can be ignited reliably by the ignition plug.

To achieve the first object, according to a third aspect and feature of the present invention, a swirling is provided to the air and the fuel supplied to the first fuel liquid film forming passage.

With the above arrangement, prior swirling is provided to the air and the fuel supplied to the first fuel liquid film forming passage and hence, the atomization of the fuel in the first fuel liquid film forming passage can be further promoted effectively.

To achieve the above first object, according to a fourth aspect and feature of the present invention, a prior swirling is provided to the air and the fuel which is supplied to the second fuel liquid film forming passage.

With the above arrangement the prior swirling is provided to the air and the fuel supplied to the second fuel liquid film forming passage and hence, the atomization of the fuel in the second fuel liquid film forming passage can be further promoted effectively.

To achieve the above second object, according to a fifth aspect and feature of the present invention, there is provided a combustor for a gas turbine engine, comprising a fuel nozzle for supplying fuel and air to a premixing/pre-evaporating chamber which is disposed at a location upstream of a single can type homogeneous combustion chamber. The fuel nozzle includes an annular fuel liquid film forming passage disposed on a radially inner side for supplying the fuel and air to the premixing/pre-evaporating chamber, an annular air passage surrounding an outer periphery of the fuel liquid film forming passage for supplying the air to the premixing/pre-evaporating chamber, and an air blast-type nozzle tip for allowing the fuel and air supplied from the fuel liquid film forming passage and the air supplied from the air passage to meet with one another for atomizing the fuel. The fuel liquid film forming passage includes a swirler for prior swirling the air flowing in the fuel liquid film forming passage, and a fuel injecting port for injecting the fuel in the direction tangential to the fuel liquid film forming passage to prior swirl the fuel, so that radially outer portions of the swirled flow of the fuel and air supplied from the fuel liquid film forming passage via the nozzle tip to the premixing/pre-evaporating chamber are covered with a straight flow of the air supplied from the air passage via the nozzle tip to the premixing/pre-evaporating chamber, thereby inhibiting the self-ignition in the center portion of the swirled flow.

With the above arrangement, the fuel liquid film forming passage of the fuel nozzle includes a swirler for prior swirling the air flowing in the fuel liquid film forming passage of the fuel nozzle, and a fuel injecting port for injecting the fuel in the same direction as the flow of the prior swirled air. Therefore, the atomization of the fuel can be promoted by generating the strong swirled flow of the air and fuel supplied to the fuel liquid film forming passage. In addition, the radially outer portions of the swirled flows of the fuel and air supplied from the fuel liquid film forming passage of the fuel nozzle via the nozzle tip to the premixing/pre-evaporating chamber are surrounded by the straight flow of the air supplied from the air passage of the fuel nozzle via the nozzle tip to the premixing/pre-evaporating chamber. Therefore, it is possible to reliably avoid that the stagnated portion at the center of the swirled flow which could be self-ignited by a back fire from the homogeneous combustion chamber.

To achieve the above second object, according to a sixth aspect and feature of the present invention, a swirler is provided at a downstream end of the premixing/pre-evaporating chamber connected to the homogeneous combustion chamber.

With the above arrangement, the back fire from the homogeneous combustion chamber to the premixing/pre-evaporating chamber can be prevented by inhibiting the stagnation of the fuel-air mixture by the swirler provided at the downstream end of the premixing/pre-evaporating chamber, thereby further reliably preventing the self-ignition of the fuel-air mixture in the premixing/pre-evaporating chamber.

The above and other objects, features and advantages of the invention will become apparent from the following description of the preferred embodiment taken in conjunction with the accompanying drawings.

BRIEF DESCRIPTION OF THE DRAWINGS

FIGS. 1 to 8 show an embodiment of the present invention, wherein:

FIG. 1 is a vertical sectional view of a gas turbine engine.

FIG. 2 is an enlarged sectional view taken along a line 2—2 in FIG. 1.

FIG. 3 is an enlarged vertical sectional view of a combustor for the gas turbine engine.

FIG. 4 is an enlarged view of an essential portion shown in FIG. 3.

FIG. 5 is a sectional view taken along a line 5—5 in FIG. 3.

FIG. 6 is a sectional view taken along a line 6—6 in FIG. 3.

FIG. 7 is a graph showing the relationship between the number of swirls and the particle size of fuel in a second fuel liquid film forming passage.

FIG. 8 is a graph showing the profile of flow speed in the direction of flow in the second fuel liquid film forming passage.

DESCRIPTION OF THE PREFERRED EMBODIMENT

The present invention will now be described by way of an embodiment with reference to the accompanying drawings.

First, the outline of the structure of a gas turbine engine E will be described with reference to FIGS. 1 and 2.

Figure 1:
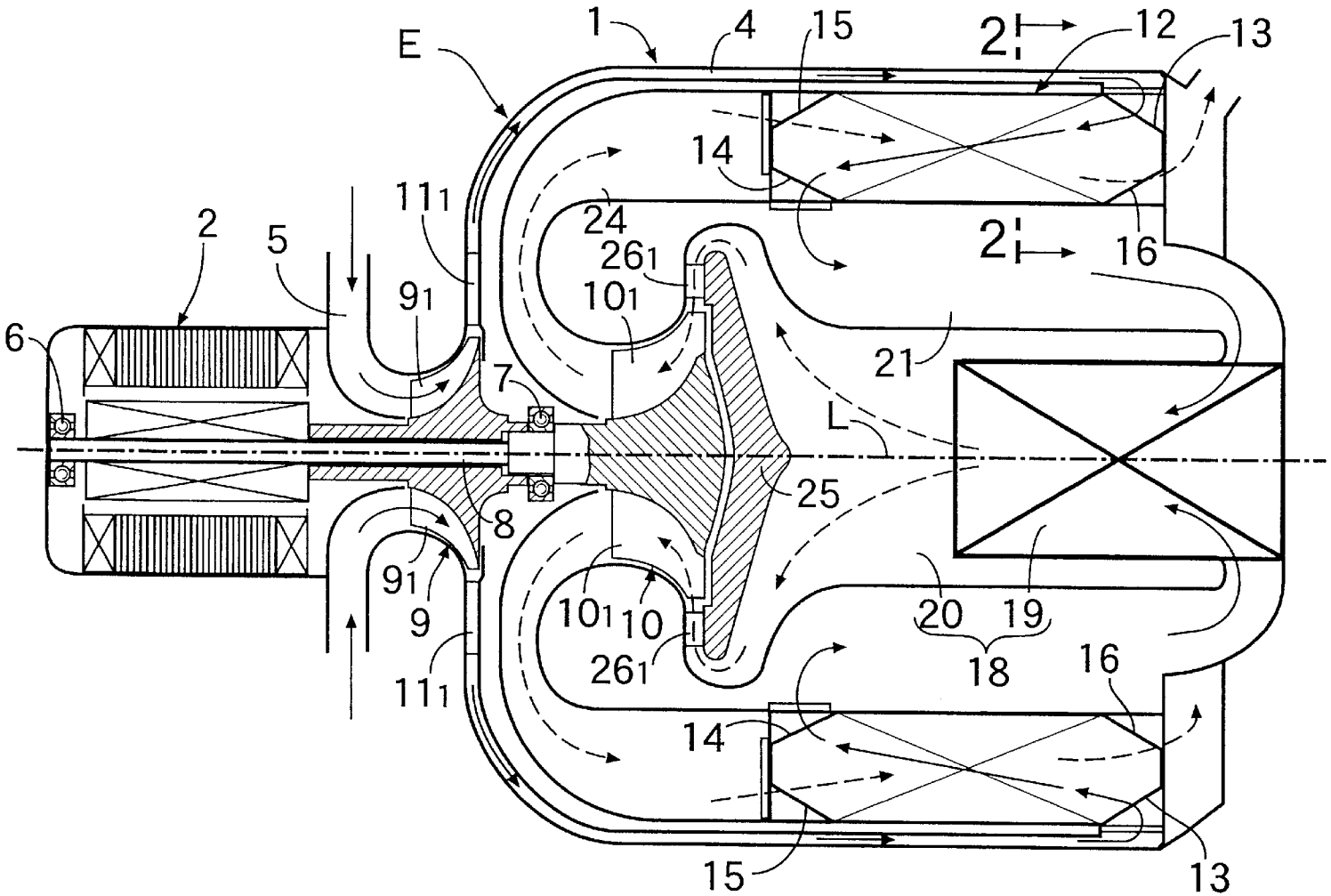

As shown in FIG. 1, the gas turbine engine E includes an engine casing 1 formed into a substantially cylindrical shape. A compressed-air passage 4 is defined in the outer periphery of the engine casing 1, and an intake passage 5 connected to an air cleaner and a silencer (both not shown), is connected to an upstream portion of the compressed-air passage 4.

A centrifugal compressor wheel 9 and a centrifugal turbine wheel 10 are coaxially fixed adjacent each other, to a rotary shaft 8 which passes through the central portion of the intake passage 5 and is supported by a pair of bearings 6 and 7. The rear bearing 7 is disposed between the compressor wheel 9 and the turbine wheel 10 and hence, the amount of turbine wheel 10 protruding rearwards from the bearing 7 can be decreased to alleviate the vibration, as compared with the case where the bearing 7 is disposed in front of the compressor wheel 9. A plurality of compressor blades $\mathbf{9}_1$ are formed radiately around an outer periphery of the compressor wheel 9 to face the intake passage 5, and a plurality of compressor diffusers $\mathbf{11}_1$ are provided in the compressed-air passage 4 located immediately downstream from the compressor blades $\mathbf{9}_1$. A generator 2 is mounted at a front end of the rotary shaft 8 and is driven by the turbine wheel 10.

An annular heat transfer-type heat exchanger 12 is disposed at a rear end of the engine casing 1. The heat transfer-type heat exchanger 12 includes a compressed-air inlet 13 at a location closer to an outer periphery at its rear end, a compressed-air outlet 14 at a location closer to an inner periphery at its front end, a combustion gas inlet 15 at a location closer to the outer periphery at its front end, and a combustion gas outlet 16 at a location closer to the inner periphery at its rear end.

Figure 2:
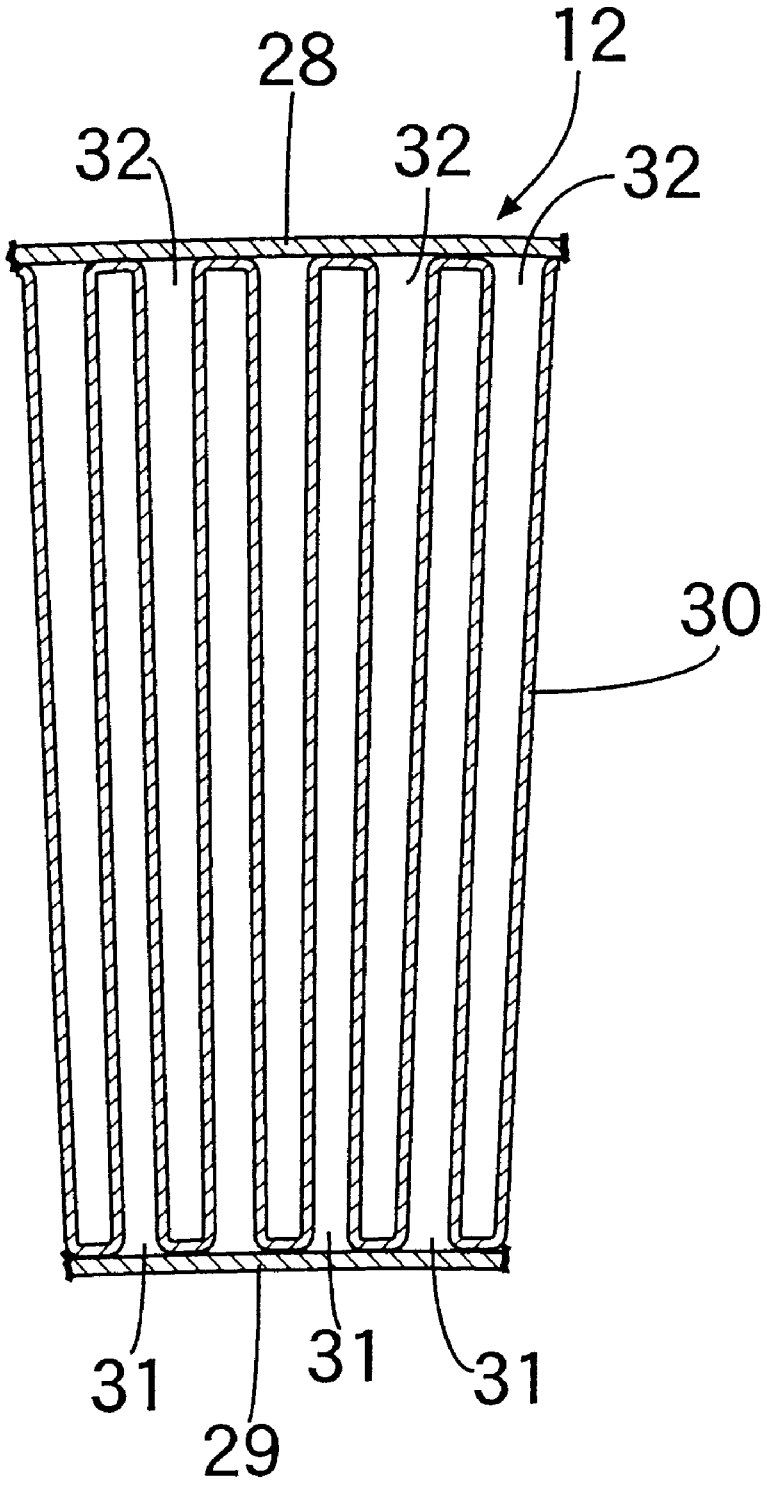

As can be seen from FIG. 2, the heat transfer-type heat exchanger 12 is comprised of a large-diameter cylindrical outer housing 28 and a small-diameter cylindrical inner housing 29 coupled to each other by a heat transfer plate 30 which is formed by folding a metal plate in a zigzag manner, whereby compressed-air flow paths 31 and combustion gas flow paths 32 are alternately defined on opposite sides of the heat transfer plate 30.

By allowing the compressed air of a relatively low temperature shown by a solid line and the combustion gas of a relatively high temperature shown by a broken line to flow in opposite directions, as shown in FIG. 1, a large difference in temperature between the compressed air and the combustion gas can be maintained over the entire length of each of the flow paths to enhance the heat exchange efficiency.

A single can type combustor 18 includes a premixing section 19 disposed on an upstream side, and a homogeneous combustion chamber 20 disposed on a downstream side. The compressed-air outlet 14 of the heat transfer-type heat exchanger 12 and the premixing section 19 are connected to each other by a compressed-air passage 21. A plurality of turbine blades $\mathbf{10}_1$ formed radially around an outer periphery of the turbine wheel 10, face an upstream area of a combustion gas passage 24 which connects the homogeneous combustion chamber 20 and the combustion gas inlet 15 of the heat transfer-type heat exchanger 12 to each other. A heat shield plate 25 for guiding the combustion gas from the homogeneous combustion chamber 20 and turbine nozzles 26, are provided at locations further upstream of the turbine blades $\mathbf{10}_1$.

The structure of the premixing section 19 will be further described in detail with reference to FIGS. 3 to 6.

The premixing section 19 has a structure substantially axially symmetrical about an axis L of the engine casing 1 (see FIG. 1) and includes a first fuel nozzle 41 located on the axis L, a second fuel nozzle 42 disposed to surround an outer periphery of an upstream (right as viewed in FIG. 3) portion of the first fuel nozzle 41, and a premixing/pre-evaporating chamber 43 defined in an annular shape to surround the outer periphery of the first fuel nozzle 41. An annular plenum chamber 44 is defined around an outer periphery of an upstream portion of the premixing section 19 to communicate with the compressed-air passage 21 through a plurality of air introduction ports 45.

The first fuel nozzle 41 is a double-pipe structure, and a first fuel liquid film-forming passage 46 extends through the center of the first fuel nozzle 41. A first air passage 47 is defined to surround an outer periphery of the first fuel liquid film-forming passage 46 and curved radially outwards at its upstream end to communicate with the plenum chamber 44. An intermediate portion of the first air passage 47 communicates with the upstream end of the first fuel liquid film-forming passage 46 through a swirler 48, and a swirler 50 is provided at the downstream end of the first fuel liquid film-forming passage 46. A first fuel passage 51 is defined in the first fuel nozzle 41, and a plurality of fuel injecting ports 52 are defined in the inner periphery of an annular groove 54 connected to the downstream end of the first fuel passage 51, and open into the upstream portion of the first fuel liquid film forming passage 46 at a location immediately downstream of the swirler 48. The fuel injecting ports 52 open into the first fuel liquid film forming passage 46 in the tangential direction (see FIG. 5). The first fuel liquid film forming passage 46 and the first air passage 47 open into the downstream end of the first fuel nozzle 41 facing the homogeneous chamber 20, and an annular opening of the first air passage 47 surrounds the outer periphery of an opening of the first fuel liquid film forming passage 46 located on the axis L, thereby forming an air blast-type nozzle tip 53.

An upstream end of the premixing/pre-evaporating chamber 43 and the plenum chamber 44 are connected to each other by a second fuel liquid film forming passage 56 and a second air passage 57. A swirler 58 is provided at the upstream end of the second fuel liquid film forming passage 56, and a plurality of fuel injecting ports 60 are defined in the inner periphery of an annular groove 55 connected to a second fuel passage 59, and open into an intermediate portion of the second fuel liquid film forming passage 56. The fuel injecting ports 60 open into the second fuel liquid film forming passage 56 in the tangential direction (see FIG. 6). The downstream end of the second fuel liquid film forming passage 56 facing the upstream end of the premixing/pre-evaporating chamber 43, opens annularly, and the downstream end of the second air passage 57 opens annularly to surround the outer periphery of the second fuel liquid film forming passage 56, thereby forming an air blast-type nozzle tip 61. A swirler 62 is provided at the downstream end of the premixing/pre-evaporating chamber 43 facing the homogeneous combustion chamber 20 to surround an outer periphery of the nozzle tip 53 of the first fuel nozzle 41.

To ignite a fuel-air mixture at the start of the gas turbine engine E, a ignition plug 63 comprising a ceramic heater, extends in parallel to the first fuel nozzle 41 through the second fuel nozzle 42, with its tip end facing in the vicinity of the nozzle tip 53 of the first fuel nozzle 41.

The operation of the embodiment of the present invention will be described below.

Referring to FIG. 1, air drawn from the intake passage 5 and compressed by the compressor wheel 9 is fed through the compressed-air passage 4 to the heat transfer-type heat exchanger 12, where the air is heated by heat exchange with the high-temperature combustion gas. The compressed air passes through the heat transfer-type heat exchanger 12 and is fed via the compressed-air passage 21 to the premixing section 19 of the single can type combustor 18, where it is mixed with fuel. The fuel-air mixture flowing from the premixing section 19 into the homogeneous combustion chamber 20 of the single can type combustor 18 is burned homogeneously, the resulting combustion gas drives the turbine wheel 10, while passing through the combustion gas passage 24. Further, the combustion gas is passed through the heat transfer-type heat exchanger 12, where it is heat-exchanged with the air, and then discharged from the engine casing 1. When the turbine wheel 10 is rotated in the above manner, the rotational torque of the turbine wheel 10 is transmitted through the rotary shaft 8 to the compressor wheel 9 and the generator 2.

The operation in the premixing section 19 will be described below with reference to FIGS. 3 and 4.

The air fed from the compressed-air passage 21 via the plenum chamber 44 to the first air passage 47 in the first fuel nozzle 41 is supplied to the upstream end of the first fuel liquid film forming passage 46, and during this time, the air is passed through the swirler 48 to become a swirled flow. The fuel supplied from the first fuel passage 51 via the fuel injecting ports 52 (see FIG. 5) to the upstream end of the first fuel liquid film forming passage 46 in the first fuel nozzle 41, is formed into a swirled flow by the fuel injecting ports 52 opening in the tangential direction. The fuel as a swirled flow is mixed with the air as a swirled flow, in the same direction, whereby it is atomized. The resulting fuel is biased radially outwards by a centrifugal force of the swirled flow, whereby a fuel liquid film is formed along the outer peripheral surface of the first fuel liquid film forming passage 46. On the other hand, the air in the first air passage 47 flows along the outer periphery of the first fuel liquid film forming passage 46, and passes through the swirler 50 provided at the downstream end of the first fuel liquid film forming passage 46 to become a swirled flow. In the nozzle tip 53, the mixture of the air and the fuel injected from the downstream end of the first fuel liquid film forming passage 46 located on the inner side, meets with the air injected from the downstream end of the first air passage 47 surrounding the outer periphery of the first fuel liquid film forming passage 46, and the fuel liquid film injected from the first fuel liquid film forming passage 46, is further atomized by the pressure of the air injected at a high pressure from the first air passage 47, and thus supplied to the homogeneous combustion chamber 20.

The first fuel nozzle 41 for diffusion combustion, has the feature that the igniting property and the flame stabilizing property are excellent. The first fuel nozzle 41 supplies the fuel to the homogeneous combustion chamber 20 at the start of the gas turbine engine E at which the fuel-air mixture is required to be ignited promptly, or during deceleration in which the flame is liable to be distinguished. The diffusion combustion system is slightly less effective with respect to an emission characteristic, as compared with a premixing/pre-evaporating combustion system. However, the air and fuel supplied to the first fuel liquid film forming passage 46 are prior swirled and atomized by the swirler 48 and the fuel injecting ports 52 opening in the tangential direction, and also the fuel supplied at the nozzle tip 53 from the first fuel liquid film forming passage 46 is mixed with the high-pressure air supplied from the first air passage 47, whereby the atomization is promoted by the air blast effect. Therefore, the emission characteristic can be enhanced sufficiently in spite of the diffusion combustion system.

On the other hand, the second fuel nozzle 42 for the premixing/pre-evaporating combustion has a feature of an excellent emission characteristic and supplies the fuel to the homogeneous combustion chamber 20 during a normal operation of the gas turbine engine E excluding the start and deceleration of the gas turbine engine E. More specifically, the air in the plenum chamber 44 passes through the swirler 58 in the second fuel nozzle 42 to become a swirled flow, and is supplied to the second fuel liquid film forming passage 56. The fuel supplied from the second fuel passage 59 via the fuel injection ports 60 (see FIG. 6) to the intermediate portion of the second fuel liquid film forming passage 56, is formed into a swirled flow by the fuel injecting ports 60 opening in the tangential direction, and is mixed with the swirled flow of air in the same direction and atomized effectively. The resulting mixture is biased radially outwards by the centrifugal force of the swirled flow, whereby a fuel liquid film is formed along the outer peripheral surface of the second fuel liquid film forming passage 56. The fuel liquid film in the second fuel liquid film forming passage 56 is injected from the nozzle tip 61 to the upstream end of the premixing/pre-evaporating chamber 43, and further, the high-pressure air supplied from the plenum chamber 44 to the second air passage 57 is injected from the nozzle tip 61, to surround the outer periphery of the fuel liquid film. At the nozzle tip 61 forming the air blast nozzle, the mixture of the air and the fuel injected from the downstream end of the second fuel liquid film forming passage 56 located on the inner side, meets with the air injected from the downstream end of the second air passage 57 surrounding the outer periphery of the second fuel liquid film forming passage 56. The fuel injected from the second fuel liquid film forming passage 56 is further atomized by the pressure of the air in the second air passage 57 and supplied to the premixing/pre-evaporating chamber 43. The air-fuel mixture in the premixing/pre-evaporating chamber 43 passes through the swirler 62 to become a swirled flow and is supplied to the homogeneous combustion chamber 20.

The second fuel nozzle 42 provided to surround the first fuel nozzle 41, is necessarily of a large diameter and for this reason, is less effective for atomizing the fuel. However, the atomization of the fuel is promoted by intensifying the swirl applied to the air flowing in the second fuel liquid film forming passage 56 by the swirler 58 and increasing the flow speed of the air flowing in the second fuel liquid film forming passage 56.

Figure 7:
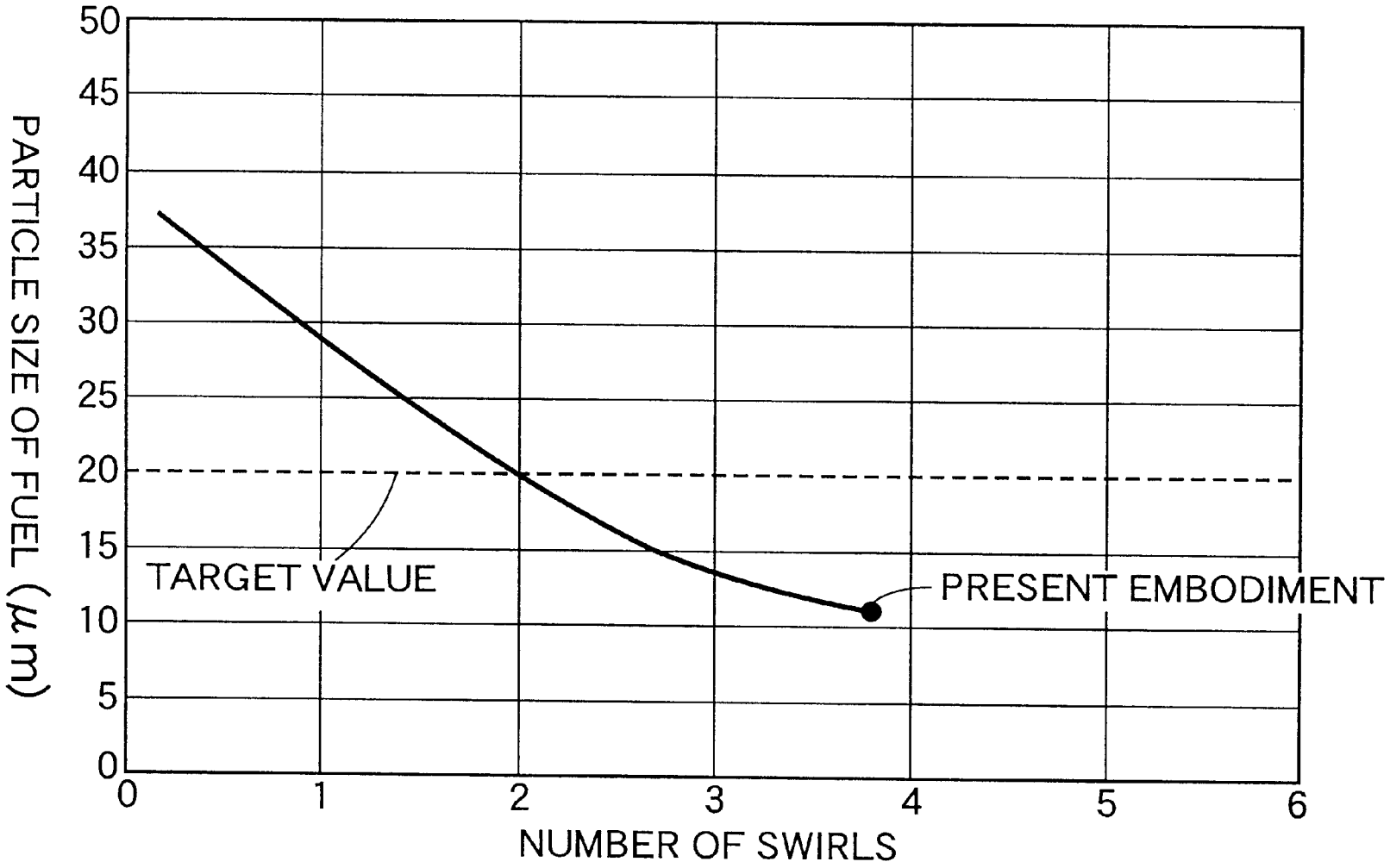

FIG. 7 is a graph showing the relationship between the number of swirls and the particle size of the fuel in the second fuel liquid film forming passage 56, wherein a fuel particle size remarkably lower than the minimum value of target fuel particle size, is ensured by sufficiently increasing the number of swirls generated by the swirler 58 in the present embodiment.

Figure 8:
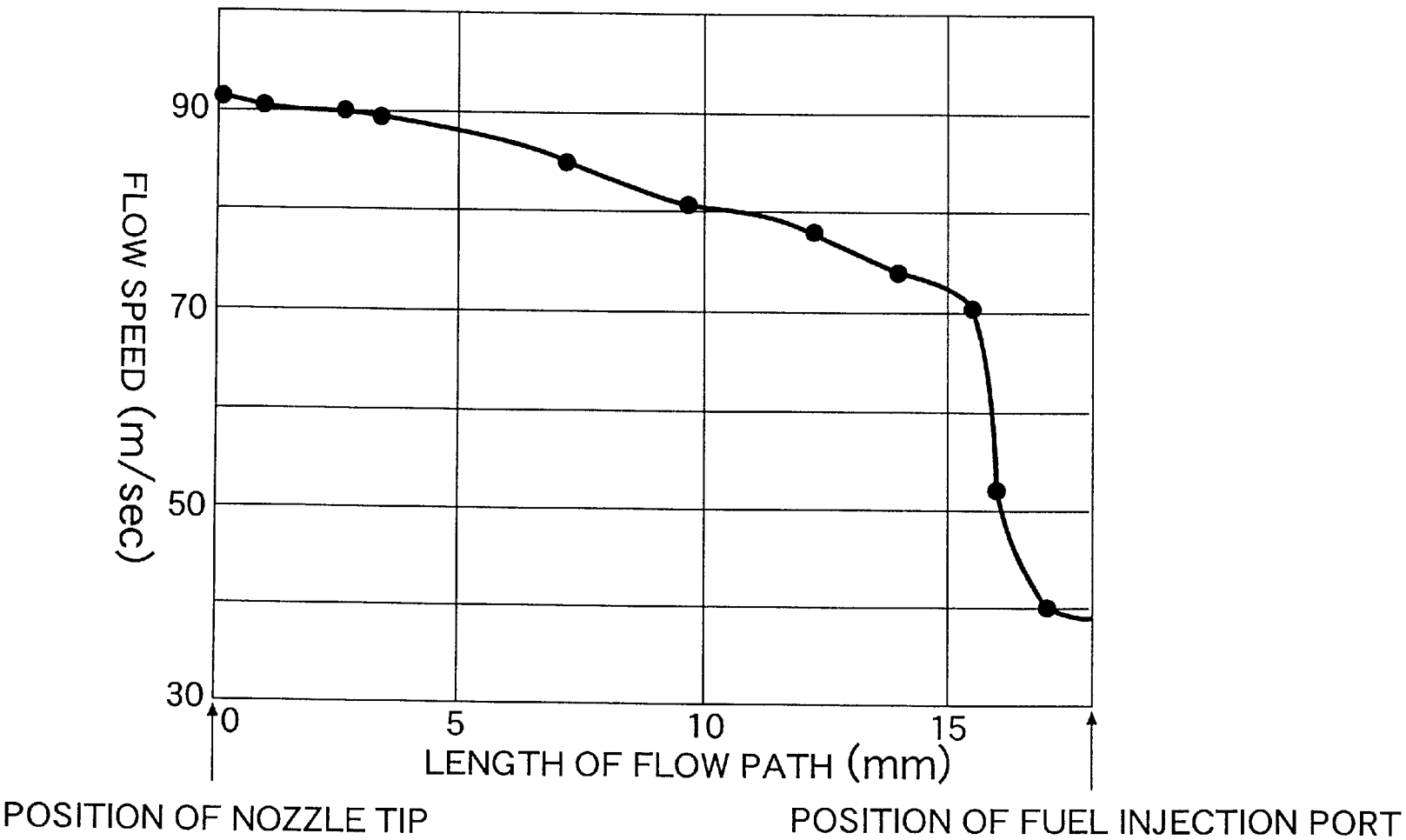

FIG. 8 is a graph showing a profile of flow speed in the direction of flow in the second fuel liquid film forming passage 56, wherein the maximum flow speed is provided in a position corresponding to the nozzle tip 61 by gradually decreasing the cross-sectional area of the flow path of the second fuel liquid film forming passage 56 from the position corresponding to the fuel injecting ports 60 toward the position corresponding to the nozzle tip 61.

Thus, the second fuel nozzle 42 can exhibit an excellent fuel-atomizing performance, despite its large diameter, by the synergetic effect provided by the structure of the second fuel liquid film forming passage 56 and the air blast-type nozzle tip 61 at the downstream end of the second fuel liquid film forming passage 56.

The fuel-air mixture injected from the second fuel liquid film forming passage 56 via the nozzle tip 61 produces a swirled flow within the premixing/pre-evaporating chamber 43, but in general, stagnation is generated in the flow in the vicinity of the center portion of the swirled flow and for this reason, a self-ignition phenomenon is liable to be produced due to a back fire. In the present embodiment, however, the second air passage 57 opens at the nozzle tip 61 to cover the outer periphery of the second fuel liquid film forming passage 56, and moreover, the air flow supplied from the second air passage 57 into the premixing/pre-evaporating chamber 43 is a straight flow with no swirl. Therefore, the swirled flow of the fuel-air mixture on an inner side can be enclosed by the straight air flow of a large flow speed on an outer side to avoid the self-ignition phenomenon in the vicinity of the center portion of the swirled flow. Further, since the swirler 62 is disposed at the outlet of the premixing/pre-evaporating chamber 43, the stagnation of the fuel-air mixture can be inhibited by the swirler 62 to avoid the self-ignition phenomenon due to back fire.

Since both of the first fuel nozzle 41 used for the diffusion combustion and having the excellent igniting performance and the excellent flame stabilizing performance and the second fuel nozzle 41 used for the premixing/pre-evaporating combustion and having the excellent emission characteristic are used in combination, as described above, all of the igniting performance and flame stabilizing performance and the emission characteristic can be reconciled.

As can be seen from FIG. 1, the parts including the compressor wheel 9, the turbine wheel 10, the heat transfer-type heat exchanger 12 and the single can type combustor 18 are disposed axially symmetrically with respect to the axis L of the engine casing 1 passing through the center of the rotary shaft 8. As a result, the flow of the compressed air and the combustion gas within the gas turbine engine E are axially symmetrical with each other and circumferentially uniform. Therefore, it is possible to decrease the pressure loss to provide an increase in power output and a reduction in fuel consumption. In addition, the profile of temperature within the gas turbine engine E is also axially symmetrical, whereby the thermal strain of the parts is suppressed to the minimum. Thus, the smooth rotations of the compressor wheel 9 and the turbine wheel 10 are ensured, and damage to the parts made of ceramics due to thermal stress is effectively prevented. Further, the engine casing 1 and various ducts can be axially symmetric and hence, they can be made of a thin material such as sheet metal, thereby achieving a reduction in weight, and also decreasing the heat loss during a cold start by a decrease in heat mass to enable a further reduction in fuel consumption.

The uniformity of the density and flow speed of the air in the inlet of the single can type combustor 18 is important for the reduction of the amount of harmful components in the combustion gas, and the flow of the air flowing into the single can type combustor 18 can be made axially symmetric by the above-described axially symmetric disposition. Further, the uniformity of the flow speed in the compressed-air inlet 13 and the combustion gas inlet 15 in the heat transfer-type heat exchanger 12 is important for providing an increase in heat exchange efficiency and a reduction in pressure loss, and the flow of the compressed air and the combustion gas flowing into the heat transfer-type heat exchanger 12 can be made axially symmetric by the above-described axially symmetric disposition.

Figure 3:
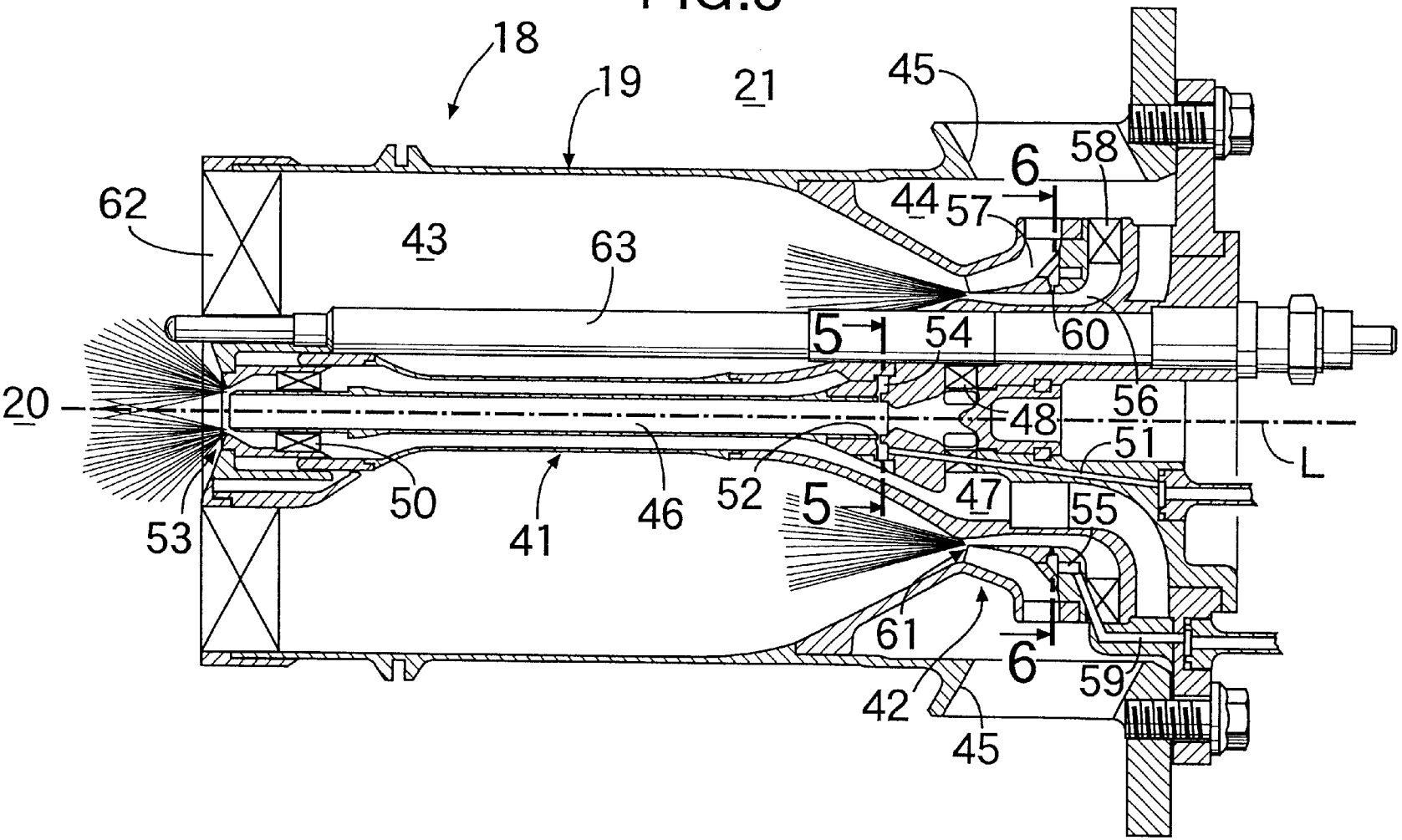
Figure 4:
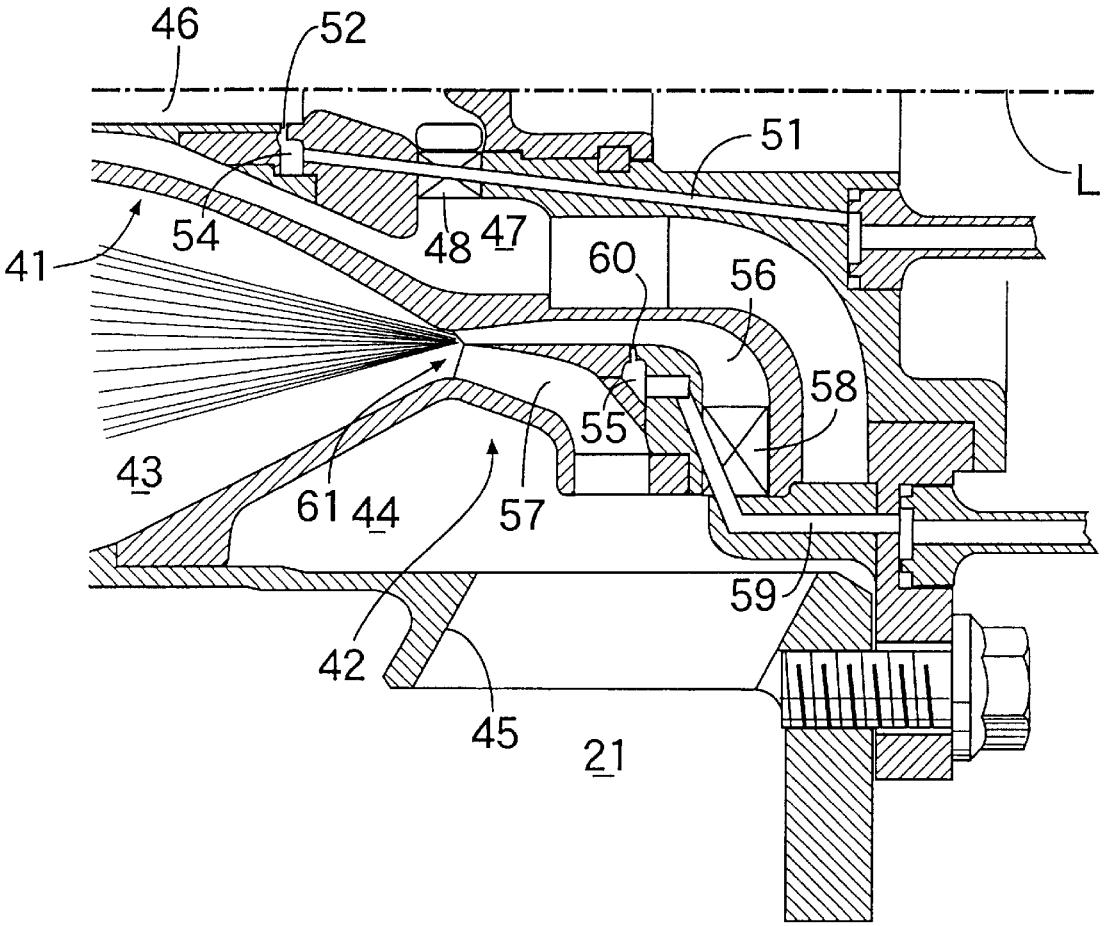
Figure 5:
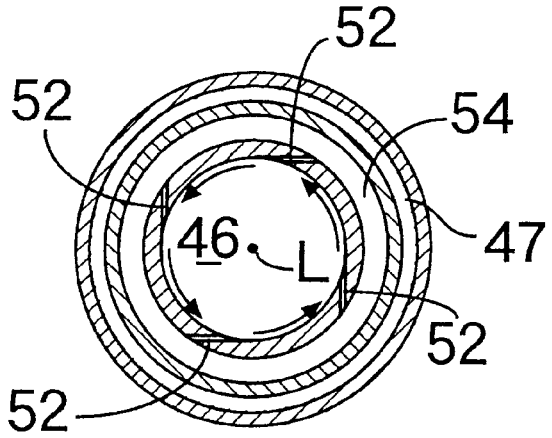
Figure 6:
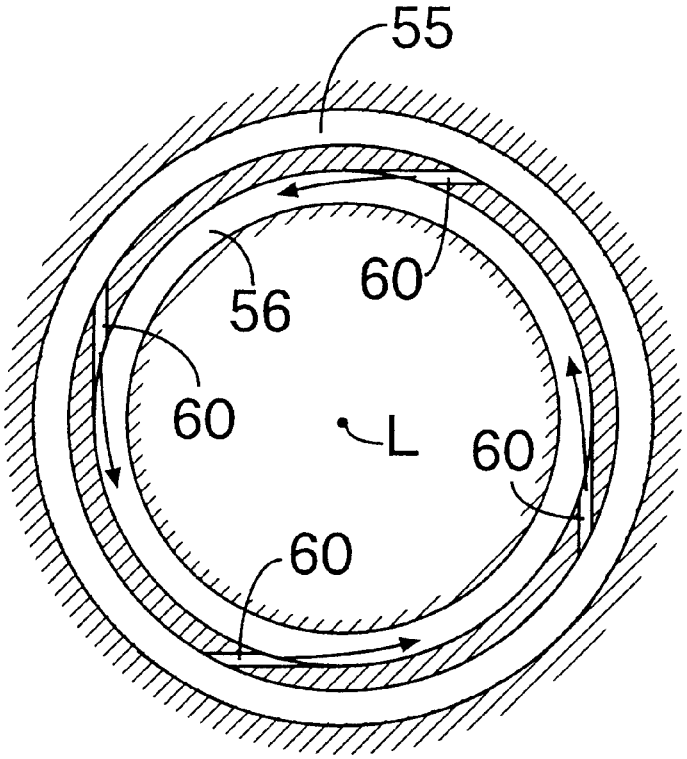

Further, as can be seen from FIG. 3, the homogeneous combustion chamber 20, the premixing/pre-evaporating chamber 43, the first fuel nozzle 41 and the second fuel nozzle 42 which comprise the single can type combustor 18 are also disposed axially symmetric with respect to the axis L and hence, the flow of the air, the fuel, the fuel-air mixture and the combustion gas are axially symmetrical and circumferentially uniform. As a result, the fuel-air ratio of the fuel-air mixture supplied to the homogeneous combustion chamber 20 is uniform circumferentially, whereby the emission characteristic is further enhanced, and also the profile of temperature in the various portions of the single can type combustor 18 is axially symmetrical, whereby the thermal strain can be suppressed to a minimum.

Although the embodiment of the present invention has been described in detail, it will be understood that the present invention is not limited to the above-described embodiment, and various modifications in design may be made without departing from the spirit and scope of the invention defined in claims.

What is claimed is:

1. A combustor for a gas turbine engine having an engine casing, said combustor comprising a single can type homogeneous combustion chamber disposed on an axis of the engine casing, a first fuel nozzle disposed on said axis for supplying a fuel-air mixture to the upstream end of said homogeneous combustion chamber, a premixing/pre-evaporating chamber surrounding the outer periphery of said first fuel nozzle and connected to the upstream end of said homogeneous combustion chamber, and a second fuel nozzle surrounding the outer periphery of said first fuel nozzle, for supplying the fuel-air mixture to the upstream end of said premixing/pre-evaporating chamber, wherein said first fuel nozzle is an air blast nozzle including a first fuel liquid film forming passage disposed on said axis, for supplying the fuel, and a first annular air passage surrounding the outer periphery of said first fuel liquid film forming passage, for supplying air, and wherein said second fuel nozzle is an air blast nozzle including a second annular fuel liquid film forming passage surrounding the outer periphery of said axis, for supplying the fuel, and a second annular air passage surrounding the outer periphery of said second fuel liquid film forming passage, for supplying air.

2. A combustor for a gas turbine engine according to claim 1, further including a ignition plug disposed in the vicinity of the nozzle tip of said first fuel nozzle.

3. A combustor for a gas turbine engine according to claim 1, wherein a swirling is provided to the air and the fuel supplied to said first fuel liquid film forming passage.

4. A combustor for a gas turbine engine according to claim 1, wherein a swirling is provided to the air and the fuel supplied to said second fuel liquid film forming passage.

5. A combustor for a gas turbine engine, comprising a premixing/pre-evaporating chamber, a single can type homogeneous combustion chamber, and a fuel nozzle for supplying fuel and air to said premixing/pre-evaporating chamber, said premixing/pre-evaporating chamber being upstream of said single can type homogeneous combustion chamber, said fuel nozzle including an annular fuel liquid film forming passage disposed on the radially inner side thereof for supplying the fuel and air to said premixing/pre-evaporating chamber, an annular air passage surrounding the outer periphery of said fuel liquid film forming passage for supplying the air to said premixing/pre-evaporating chamber, and an air blast-type nozzle tip for allowing the fuel and air supplied from said fuel liquid film forming passage and the air supplied from said air passage to meet for atomizing the fuel, wherein said fuel liquid film forming passage includes a swirler for swirling the air flowing in said fuel liquid film forming passage, and a fuel injecting port for injecting the fuel in the direction tangential to said fuel liquid film forming passage to swirl the fuel, whereby the radially outer portions of the swirled flows of the fuel and air supplied from said fuel liquid film forming passage via said nozzle tip to said premixing/pre-evaporating chamber are enclosed in a straight flow of the air supplied from said air passage via said nozzle tip to said premixing/pre-evaporating chamber, thereby inhibiting the self-ignition in the center portion of the swirled flow.

6. A combustor for a gas turbine engine according to claim 5, further including a swirler at the downstream end of said premixing/pre-evaporating chamber connected to said homogeneous combustion chamber.

* * * * *